United States Patent [19]

Niemeier

[11] 4,029,270

[45] June 14, 1977

[54] MECHANICAL ROLL RATE STABILIZER FOR A ROLLING MISSILE

[75] Inventor: Byron M. Niemeier, Claremont, Calif.

[73] Assignee: General Dynamics Corporation, Pomona, Calif.

[22] Filed: Aug. 11, 1975

[21] Appl. No.: 603,403

[52] U.S. Cl. ..... 244/3.21; 244/3.23

[51] Int. Cl.[2] ..... F42B 15/14

[58] Field of Search ..... 244/3.21, 3.23

[56] References Cited

UNITED STATES PATENTS

| | | | |
|---|---|---|---|
| 3,260,205 | 7/1966 | Dietrich | 244/3.23 |
| 3,578,796 | 5/1971 | Hagler et al. | 244/3.23 |
| 3,603,532 | 9/1971 | Harms | 244/3.21 |
| 3,690,596 | 9/1972 | Durran | 244/3.21 |

*Primary Examiner*—Verlin R. Pendegrass

*Attorney, Agent, or Firm*—Neil F. Martin; Edward B. Johnson

[57] ABSTRACT

A stabilizer system for use with an aerodynamic body having pivotal control surfaces to control the roll rate of the body. A pair of high mass members are diametrically supported for radial displacements induced by the centrifugal forces on the body. A pair of drive racks project from the high mass members and engage a pinion rotatably mounted on a centrally disposed axle. Another pinion is supported at the axially off-set distal end of the axle. It imparts rotational motion to a pair of connecting members by means of gear sectors mounted on shafts which are adapted to cause pivotal displacements of the control surfaces to increase or decrease the deflection thereof. This produces a corresponding increase or decrease of the roll rate of the aerodynamic body.

7 Claims, 4 Drawing Figures

MECHANICAL ROLL RATE STABILIZER FOR A ROLLING MISSILE

BACKGROUND OF THE INVENTION

Reentry vehicles, missiles and other aerodynamic bodies are subjected to various instabilities in their flight dynamics. These effects may degrade flight performance and negate desired flight objectives. The effects may subject the vehicle to excessive or insufficient centrifugal or centripetal forces. Also, these effects may adversely modify the angle of attack of the body.

Unwanted modifications of flight dynamics may result from improper roll rate. Improper roll rate is a function of aerodynamic asymmetries that may result from insufficient manufacturing tolerances. These asymmetries may be difficult to engineer out of the system. Furthermore, any such engineering may increase the manufacturing cost of the vehicle. Therefore, it is useful to control roll rate by employment of a roll rate controller rather than imposing excessive tolerance standards on the vehicle. It is desirable to maintain a relatively constant roll rate to simplify the guidance and pitch control components of the vehicle. Absent roll rate control, the roll rate is proportional to the velocity. Velocity and consequently roll rate may vary by a factor of about 3 through the vehicle flight. Also, the roll rate may be highly responsive to the geometric requirements of the vehicle, such as wrap around tail fins. Therefore, roll rate is a highly variable characteristic and a stabilizer system is preferred to exacting extremely close tolerances. In some designs, the requirement of extremely close tolerances is still inadequate to yield the desired roll rate characteristics during the flight. Some method of controlling the roll rate is required.

Control systems that have previously been employed include the type that utilize vehicle internally generated energy, sensing instrumentation and a control actuation system. The deficiency in these systems are the addition of excessive weight to the vehicle and the power drain on the vehicle energy system.

They are also cumbersome and occupy an excessive part of the vehicle volume. Other systems are known as passive in that they utilize body geometry and aerodynamic effects to control the roll rate. These systems have been lacking in reliability and are not extensively employed. Furthermore, many of these devices are sensitive to vehicle maneuvering. The acceleration forces developed during such maneuvering adversely affect the stabilizing characteristics of these devices.

A roll rate control stabilization system has been needed that is actuated by and sensitive to the centrifugal and centripetal forces developed by the vehicle. The prior art is particularly deficient in providing a control system in which the roll rate imbalance is the motivating force in correcting the roll rate and which is compact, simple and insensitive to vehicle maneuvering.

SUMMARY OF THE INVENTION

In an exemplary embodiment of the invention, a pair of inertial means in the form of relatively high mass members are adapted for being supported within the aerodynamic body for radial displacements. An increase in roll rate of the aerodynamic body increases the centrifugal force on the high mass members causing outward radial displacements. A decrease in roll rate of the aerodynamic body reduces the centrifugal force on the high mass members. This permits an urging means in the form of resilient springs to radially inwardly displace the high mass members. The resilient springs are active between the interior wall of the aerodynamic body and a slot formed in the high mass members. Furthermore, the high mass members are disposed diametrically within the aeordynamic body, such that the axes of the resilient springs will be co-linear.

First drive members, in the form of racks are connected to each of the high mass members and project inwardly along parallel chords of the aerodynamic body. The racks engage a centrally disposed first driven means or pinion. As the racks move in opposite directions, but with equal radial increments, they cause the pinion to be rotated clockwise or counter-clockwise depending upon the direction of the radial motion of the high mass members. For instance, an increase in the centrifugal force on the aerodynamic body, causes the high mass members to move radially outwardly compressing the resilient springs. That motion causes a clockwise rotation of the pinion. Conversely, a decrease in the rolling rate of the aerodynamic body permits the resilient springs to move the high mass members radially inwardly, causing a counter-clockwise rotation of the pinion.

The pinion is fast on a central axle that is adapted for projecting axially within the aerodynamic body. A second drive means in the form of a gear is fast on the axle at the distal end thereof. It is off-set from the plane of the high mass members. The gear engages second driven means in the form of a pair of gear sectors that are disposed generally parallel with respect to the central shaft. The pivotal ends of the gear sector members are generally co-planar with the pinion. This makes for a compact folded type device that does not occupy excessive volume in the body. A pair of shafts are connected to the gear sector members. The shafts are journaled in bearings and extend through the aerodynamic body and are connected to the control surfaces. It should be noted that the control surfaces may be stowed within the aerodynamic body adjacent the stabilizer apparatus.

If the roll rate of the aerodynamic body decreases, the resilient springs overpower the centrifugal force on the high mass members, pushing them together. This motion is transmitted through the drive gear and gear sector linkage to cause the control surfaces to pivot and increase the control deflection. Such pivoting leads to the desired increase in the roll rate of the aerodynamic body. Conversely, if the roll rate increases, the high mass members displace radially outwardly, causing a counter-clockwise rotation of the axle and the drive gear. This motion is translated, via the gear sector members, into a decrease in the control deflection, thus decreasing the roll rate of the aerodynamic body. Since the high mass members displace equally in opposite directions, the device is insensitive to vehicle maneuvering.

It is an object of the invention to provide a new and improved rolling stabilizer system for aerodynamic bodies.

Another object of the invention is to provide a new and improved rolling stabilizer system that does not utilize aerodynamic body internally generated energy.

Another object of the invention is to provide a new and improved rolling stabilizer system that utilizes the forces causing the rolling imbalance to correct the roll rate.

Another object of the invention is to provide a new and improved rolling stabilizer system that requires no increase in the manufacturing tolerances to engineer out minor asymmetries.

Another object of the invention is to provide a new and improved rolling stabilizer system that is compact, contains few parts and is characterized by a predictable movement.

Another object of the invention is to provide a new and improved rolling stabilizer system that is insensitive to aerodynamic body maneuvering.

The above and other objects of the invention will be apparent as the description continues and when read in conjunction with the appended drawings.

DETAILED DESCRIPTION OF THE DRAWINGS

Figure 1:
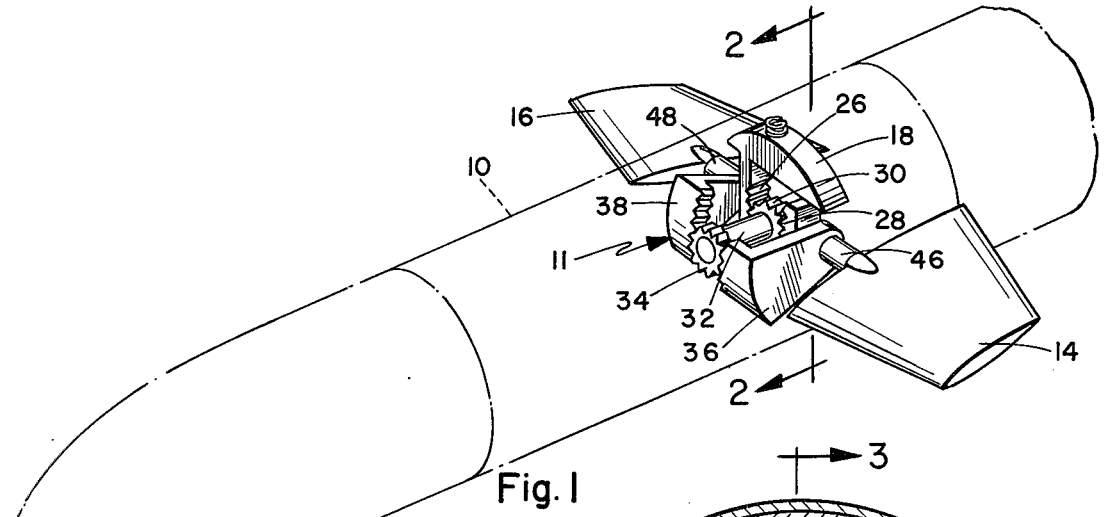
FIG. 1 is a perspective view of the mechanism in a typical missile illustrated without the supporting structure.
Figure 2:
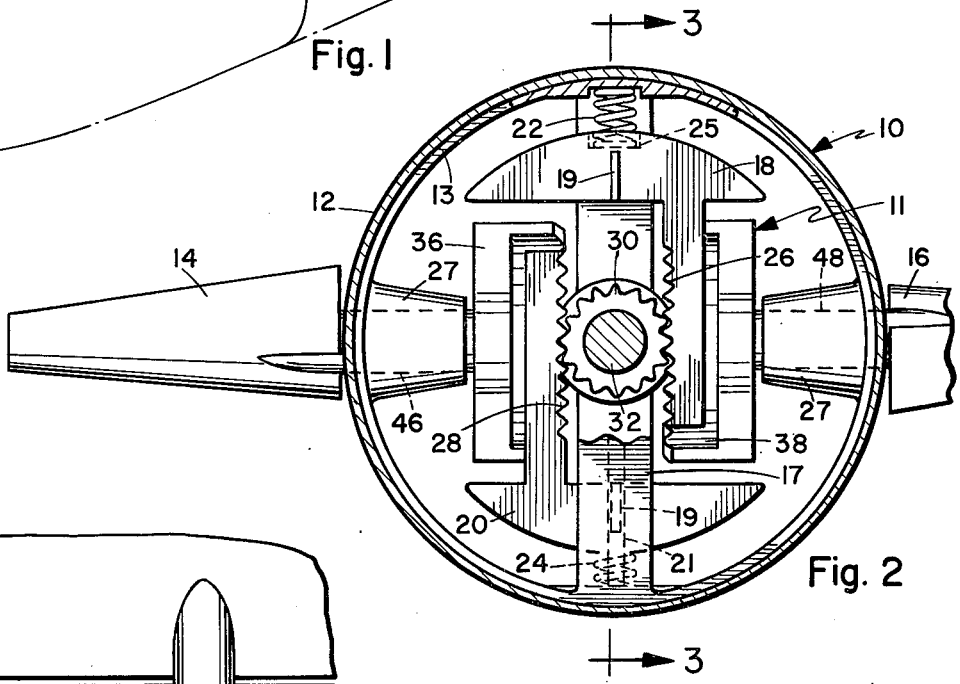
FIG. 2 is an enlarged sectional view taken on line 2—2 of FIG. 1.
Figure 4:
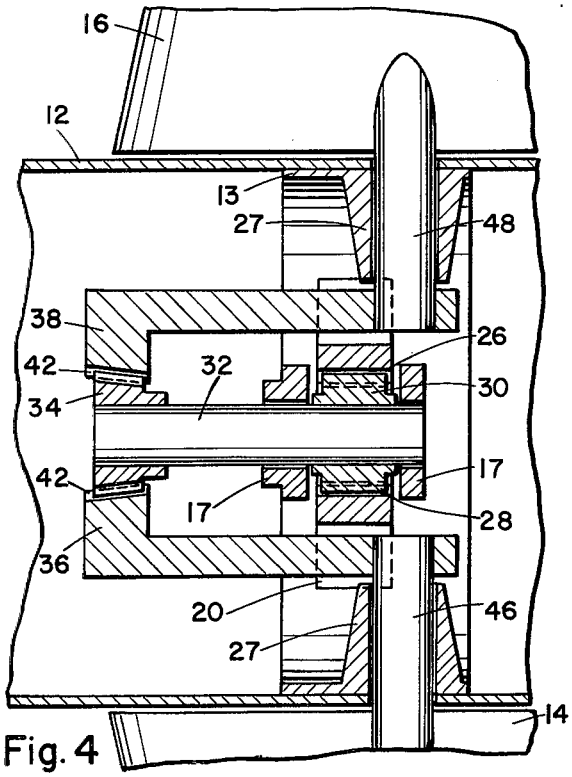
FIG. 4 is a sectional view taken on line 4—4 of FIG. 3.
Figure 3:
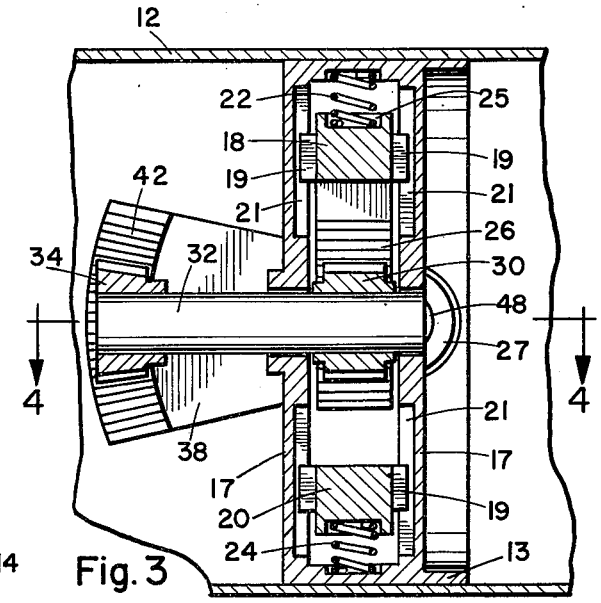
FIG. 3 is a sectional view taken on line 3—3 of FIG. 2.

As illustrated in the drawings, the aerodynamic body 10 is adapted to support a control stabilizer system 11, which is characterized by a skin 12 and fins or control surfaces 14 and 16. The stabilizer system is assembled to the support frame 13. The control surfaces 14 and 16 are aerodynamically contoured and function to increase or decrease the rolling rates of the aerodynamic body 10. The greater the surface area of the control surfaces 14 and 16 exposed to the airstream, the greater the roll rate of the aerodynamic body 10 will be. Conversely, when the control surfaces 14 and 16 are pivoted to provide a minimal surface area exposure to the airstream, they retard or slow the roll rate of the aerodynamic body 10. The aerodynamic body 10 is designed for a particular roll rate that may be a function of the aerodynamic design as well as the programmed or expected maneuvers of the aerodynamic body 10. The control stabilization system 11 therefore, is designed to function to cure an excessive or insufficient roll rate of the aerodynamic body 10.

A pair of high mass members 18 and 20 are supported within the skin 12 for radial displacements. A pair of resilient coiled springs 22 and 24 are active between the frame 13 and the high mass members 18 and 20. Slots or recesses 25 may be provided in the high mass members 18 and 20 to accommodate the interior facing ends of the springs 22 and 24. The displacements of the high mass members 18 and 20 are guided by means of guide ribs 19 in slots 21 of frame 13. The springs 22 and 24 are disposed diametrically in the body 10 such that their central axes are co-linear. A pair of racks 26 and 28 are connected to each of the high mass members 18 and 20. The racks 26 and 28 project inwardly into the aerodynamic body 10 orthogonal with respect to the high mass members 18 and 20. The high mass members 18 and 20 and the racks 26 and 28 are generally radially co-planar within the diametrical supports 17.

A pinion 30 is centrally supported within the aerodynamic body 10. An axle 32 centrally supported within the aerodynamic body 10 rotates with the same motion as the pinion 30. A gear 34 is fastened on the distal end of axle 32 and assumes the same rotational motion of the pinion 30. The pinion is engaged simultaneously by the racks 26 and 28. Movement of the high mass members 18 and 20 radially outwardly causes the pinion to rotate in a clockwise direction. As the high mass members 18 and 20 displace radially inwardly, the pinion 30 and the gear 34 experience a counter-clockwise rotation. A pair of gear sector members 36 and 38 are pivotally supported within the aerodynamic body on shafts 46 and 48 and have gear teeth 42 which engage gear 34. The shafts 46 and 48 are generally diametrical in bearings 27 in the body 10 such that their axes are co-linear and they are connected to the control surfaces 14 and 16 respectively. The shafts 46 and 48 are generally in the plane of pinion 30 and the gear sector members 36 and 38 extend radially longitudinally, resulting in a folded mechanism requring a minimum of space. Clockwise rotation of the pinion 30 and the gear 34 is translated into pivoting of the gear sector members 36 and 38. This causes, via the shafts 46 and 48, a decrease in pitch angle of the control surfaces 14 and 16. Conversely, clockwise rotation of the gear 34 causes reverse pivoting of the gear sector members 36 and 38. This causes, via the shafts 46 and 48, pivotal movement of the control surfaces 14 and 16 to increase pitch angle. Pivoting of the control surfaces 14 and 16 in the direction of increasing the pitch angle causes an increase in the roll rate. Decreasing the control surface pitch angle to the air stream results in a decrease of the roll rate of the aerodynamic body 10.

Since the two high mass members 18 and 20 are connected about the common axle 32, the forces of the two mass members 18 and 20 due to aerodynamic body 10 acceleration forces, tend to drive the axle 32 in opposite directions. This results in no net rotation of the axle 32, or through the gear 34, of the control surfaces 14 and 16. Furthermore, gravitational effects on the high mass members 18 and 20 are negated by the fact that they tend to produce opposing rotation of the axle 32. The rolling stabilizer system therefore, is insensitive to aerodynamic body maneuver acceleration forces and external gravitational forces. Furthermore, sufficient space is left in the aerodynamic body in the vicinity of the stabilizer apparatus to accommodate folding control surfaces in a stowed position.

Having described my invention, I now claim:

1. A rolling stabilizer system for use with an aerodynamic body having pivotal control surfaces projecting therefrom comprising:

inertia means comprising at least two relatively high mass members supported in the aerodynamic body for radial displacements, an actuator means connected and responsive to the radial displacements of said high mass members for corresponding rotational displacements, means for adjusting the orientation of the control surfaces responsive to the rotation of said actuator means and operative to rotate the control surfaces in increments corresponding to the rotation of said actuator means and to cause a corresponding increase and decrease in the roll rate of the aerodynamic body, said means for adjusting the orientation comprising a first drive means connected to each of said high mass members and active to impart rotational displacements of said actuator means proportional to said radial displacements of said high mass members and second drive means axially offset from said high mass members, said means for adjusting the orientation comprising second driven means operatively engaged by said second drive means and driven thereby for rotational displacements.

2. The stabilizer system of claim 1, wherein:

said first driven means comprises a pinion, and said first drive means comprises a pair of racks projecting from said high mass members for engagement with said pinion.

3. The stabilizer system of claim 1, wherein:

said second drive means comprises a gear, and said second driven means comprises a pair of gear sector members.

4. The stabilizer system of claim 1, further comprising:

means urging said inertial means for being supported between the aerodynamic body and said high mass members.

5. The stabilizer system of claim 4 wherein:

the urging means overpowers the centrifugal force, in the event of unwanted roll rate decrease and causes inward radial displacement of said high mass members, whereby the control surface deflection is increased to increase the roll rate, and the centrifugal force overpowers the urging means, in the event of unwanted roll rate increase and causes outward radial displacement of said high mass members, whereby the control surface deflection is decreased to decrease the roll rate.

6. The stabilizer system of claim 1 wherein:

said means for adjusting the orientation comprises a pair of gear sector members responsive to said second drive means, shaft members for being pivotally supported between said gear sector members and the control surfaces and operative to transfer pivotal displacements of said gear sector members to rotation of the control surfaces.

7. The stabilizer system of claim 6 wherein:

an axle connecting said first driven means and said second drive means.

* * * * *